US006871432B2

(12) United States Patent
Lacroix

(10) Patent No.: US 6,871,432 B2
(45) Date of Patent: Mar. 29, 2005

(54) LABEL WITH ROTARY DISPLAY ELEMENTS

(75) Inventor: Jean-Paul Lacroix, Boulogne Billancourt (FR)

(73) Assignee: Driver, Argenteuil (FR)

( * ) Notice: Subject to any disclaimer, the term of this patent is extended or adjusted under 35 U.S.C. 154(b) by 0 days.

(21) Appl. No.: 10/343,064

(22) PCT Filed: Jul. 25, 2001

(86) PCT No.: PCT/FR01/02428

§ 371 (c)(1),
(2), (4) Date: Jun. 18, 2003

(87) PCT Pub. No.: WO02/09077

PCT Pub. Date: Jan. 31, 2002

(65) Prior Publication Data

US 2003/0233774 A1 Dec. 25, 2003

(30) Foreign Application Priority Data

Jul. 26, 2000 (FR) ..... 00 09850

(51) Int. Cl.[7] ..... G09F 11/04
(52) U.S. Cl. ..... 40/495; 40/5
(58) Field of Search ..... 40/299.01, 5, 642.02, 40/495

(56) References Cited

U.S. PATENT DOCUMENTS

| | | | | | |
|---|---|---|---|---|---|
| 1,046,963 | A | * | 12/1912 | Burgquist | 40/495 |
| 1,513,158 | A | * | 10/1924 | Cook | 40/495 |
| 1,516,304 | A | * | 11/1924 | Mulvehill | 40/495 |
| 1,564,595 | A | * | 12/1925 | Lohrer | 40/5 |
| 1,689,055 | A | * | 10/1928 | Sanders | 40/495 |
| 1,779,684 | A | * | 10/1930 | Van Sicklen, Jr. | 40/495 |
| 2,842,877 | A | * | 7/1958 | Stevens | 40/495 |
| 4,280,291 | A | * | 7/1981 | Maynes | 40/495 |
| 4,958,455 | A | * | 9/1990 | Jacobsen | 40/495 |
| 2002/0139022 | A1 | * | 10/2002 | Gross | 40/495 |

FOREIGN PATENT DOCUMENTS

| | | |
|---|---|---|
| CH | 272122 | 11/1950 |
| EP | 0949600 A2 | 10/1999 |

* cited by examiner

*Primary Examiner*—Gary C. Hoge
(74) *Attorney, Agent, or Firm*—Blakely Sokoloff Taylor & Zafman

(57) ABSTRACT

The invention concerns a label comprising a support (2), display elements (6*a*–6*f*), and means for mounting mobile elements rotatably on the support. For at least one of the display elements, the mounting means (14, 16) extend at some distance from the center of the element and are discontinuous along a circumferential direction around said center.

14 Claims, 4 Drawing Sheets

LABEL WITH ROTARY DISPLAY ELEMENTS

The present patent application is a non-provisional application of International Application No. PCT/FR01/02428, filed Jul. 25, 2001.

The invention relates to labels for displaying the prices of articles at a place of sale.

Labels with wheels are generally constituted by a printed front face having windows through which there can be seen the digits making up the prices of the articles with which they are associated. These digits may go from 0 to 9 and they are printed on the peripheries of disks that are cut out from thin sheet material. Each disk also has a central hole cut out therein enabling it to be riveted to the printed front face. This is done with clearance so that the rivets act as pins on which the disks can rotate, the disks thus being movable about their centers. Each wheel constituted in this way allows its digits to be scrolled past the associated window. The price of an article is thus defined by turning each of the wheels until the desired digit appears.

In order to make such labels, the rivet of any one wheel must naturally not be blocked by the presence of another wheel. In this sense, the wheels must be sufficiently spaced apart. Nevertheless, the windows past which the digits on each wheel travel need to be in alignment and as close together as possible in order to make up an article price that is easily identifiable. This means that the wheels must overlap as much as possible, but within the limits of feasibility for the rivets.

This constraint leads, for example, to the wheels being riveted sequentially, thus enabling certain wheels to overlap others beyond their centers. One such label is described in application EP 0 949 600. In that case, the wheels are riveted after the wheels they overlap have already been riveted, and those rivets then become masked.

Nevertheless, when using the wheel overlap obtained by sequential riveting, the need to display prices both in francs and in euros has given rise to labels that are too big, which is economically harmful both functionally and in terms of appearance. In particular they are poorly readable. Furthermore, the rivets spoil the appearance of the printed front face, regardless of whether two prices are displayed or a single price.

An object of the invention is to provide a label that is more compact, more easily readable, and of more pleasing appearance, in particular for displaying two prices.

To achieve this object, the invention provides a label comprising:

a support;

display elements; and mounting means for mounting the elements so they are free to rotate on the support, in which, for at least one of the display elements, the mounting means extend at a distance from the center of the elements and are discontinuous in a circumferential direction around the center. Thus, these mounting means enable the display elements to be moved closer to one another without making the label more bulky, even when two prices are to be displayed, while nevertheless guiding them suitably in rotation. In addition, since the label need not have any rivets, assembly is facilitated since it is possible to put all of the display elements into place on the support simultaneously.

The possibility of omitting rivets also improves the appearance of the label whose front face need not have any cavities or portions in relief.

The invention may also present at least one of the following characteristics:

at least for said display element, the mounting means bear against an outside edge of the element;

at least for said display element, the mounting means bear against an inside edge of the element;

at least for said display element, the mounting means comprise a rib;

at least for said display element, the mounting means extend over less than a half a turn in the circumferential direction, preferably over less than one-third of a turn;

the mounting means are contiguous with one another for at least two of the display elements;

the label has a front wall presenting windows through which the display elements are visible;

the label has a rear wall presenting windows through which the display elements are accessible in order to be maneuvered;

the windows in the rear wall are closed by a leakproof flexible membrane, or by a removable closure strip;

at least for said display element, the mounting means, the opening in the rear wall, and the center of the element are in alignment;

at least one of the display elements is in the form of a ring; and at least one of the display elements is in the form of a disk.

Other characteristics and advantages of the invention appear further from the following description of several preferred embodiments and variants given as non-limiting examples.

In the accompanying drawings:

FIG. 1 is an elevation view of a label constituting a first preferred embodiment of the invention;

FIGS. 2, 3, and 4 are elevation views respectively of the front wall, of the display elements, and of the rear wall of the label of FIG. 1;

FIG. 5 is an elevation view of a label constituting a second embodiment of the invention;

FIGS. 6, 7, and 8 are figures analogous to FIGS. 2, 3, and 4 showing a third embodiment;

The label 2 comprises a rear wall 4, display elements 6, and a front wall 7.

The display elements 6 are interposed between the front and rear walls, being sandwiched between them. They are also superposed in part on one another.

Figure 1:
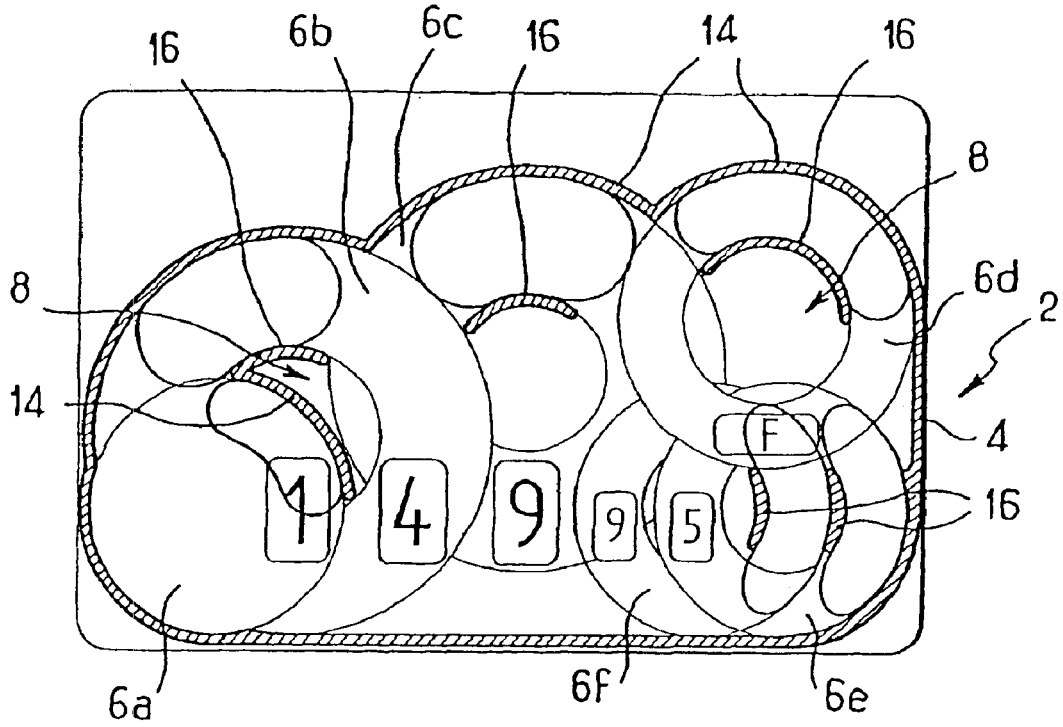
FIGS. 1 to 4 show a first embodiment of a label of the invention.
Figure 2:
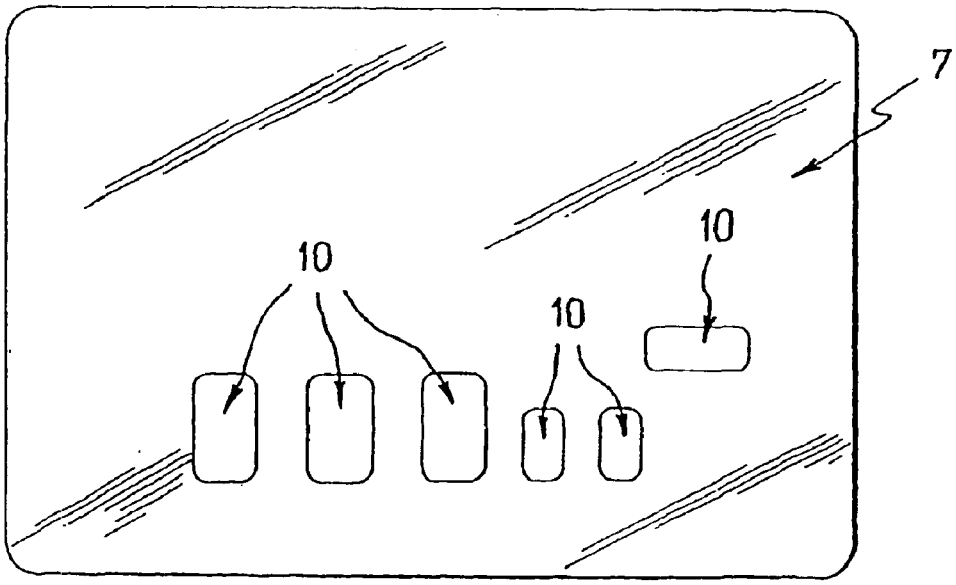
Figure 3:
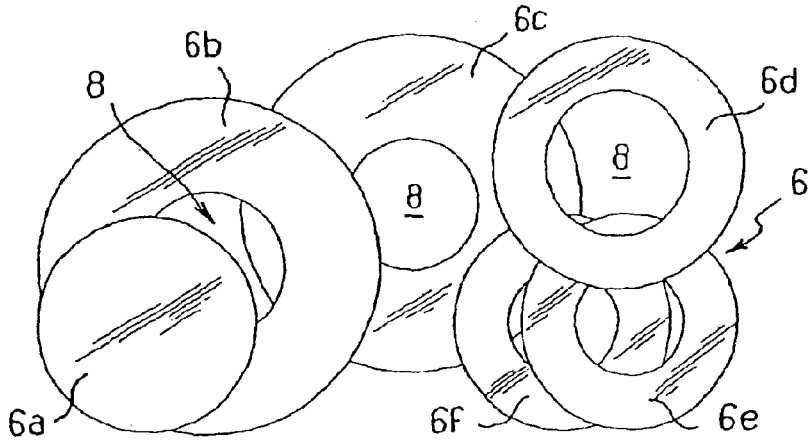
Figure 4:
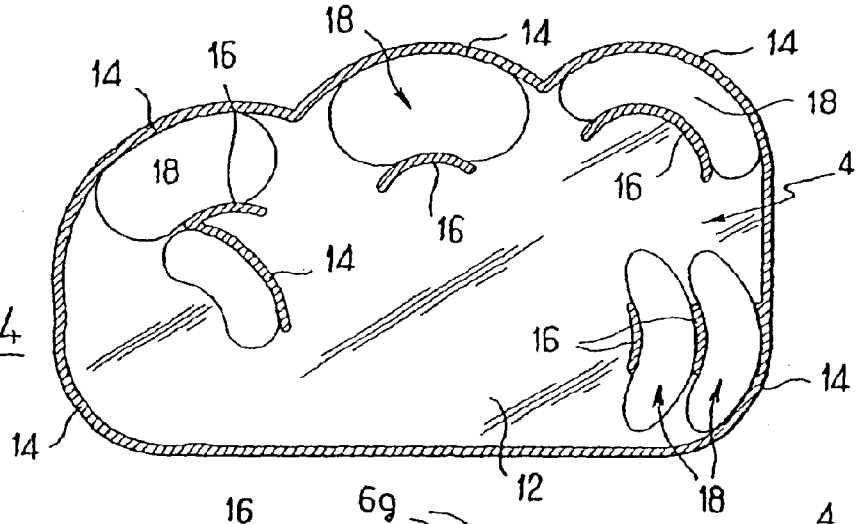

There are six display elements 6 in this case. They comprise one disk 6*a* and five rings 6*b* to 6*f*; with reference to FIG. 4, the rear wall 4 comprises a plane plate 12 with ribs 14 projecting forwards from said plate. The general shape of the plate corresponds to the geometrical envelope of the display elements 6*a*–6*f* as disposed in FIG. 3. Some of the ribs serve to guide display elements in rotation in the label.

The ribs 14 in this case are in the form of circular arcs centered on the geometrical centers of the display elements to be guided thereby.

Thus, in the middle top portion of the wall 4, the rib 14 forming the top edge of the plate is in the form of an arc of a circle identical to the outer circular edge of the second large ring 6*c* and comes to bear downwards against said edge.

In addition, the wall 4 has a circular rib 16 in its middle portion that bears upwards against the inside circular edge of said ring 6*c*, projecting for this purpose into the orifice 8 of the ring. The two ribs 14 and 16 are thus concentric and centered on the geometrical center of the ring 6*c*. They are in alignment with said center, i.e. they are intersected by a common geometrical radius emanating from said center. The two ribs 14 and 16 suffice to guide the large ring 16 in rotation about its center. Between the two rings, the plate 12 presents a kidney-shaped opening 18 which is essentially defined by the two ribs. This opening makes it possible to make contact with the ring through the rear wall 4 in order to turn it.

It should be observed that the two rings 14 and 16 and the opening 18 occupy less than half a turn around the center of the ring 6*c*, and indeed less than one-third of a turn. In this case they occupy about one-fourth of a turn.

The other large ring 6*b* is guided in like manner by two ribs 14 and 16 associated with an opening 18. The same applies to the intermediate ring 6*d* and to one of the small rings 6*e*. The other small ring 6*f* is guided by its own inner rib 16.

However its outside edge is guided by the same rib 16 as also guides the inside edge of the other small ring 6*e*. This "common" rib 16 thus has inner and outer arcs that are not concentric.

The disk 6*a* is guided by two outside ribs 14, one constituting the edge of the plate, and the other lying in the opening 8 of the first large ring 6*b* and having one end attached to the end of its inside rib 16.

The circular ribs 14 extending along the edge of the plate are interconnected, in particular by rectilinear segments. It can be seen that the guide means associated with each display element are offset and remote from the geometrical center of the element in question and discontinuous in a circumferential direction about said center. Furthermore, the guide means associated with a ring (or a disk) do not occupy the center of that ring.

Thus, the label 2 is constituted by a printed front face and by an injection-molded support piece. The ribs 14 and 16 are formed on said support piece in such a manner as to constitute housings for the display elements. These ribs placed on the outside and on the inside of the rings fit closely to their respective shapes. The rings and the disks are cut out from thin plastics sheet material.

They are retained in their housings, i.e. between their respective ribs 14 and 16 against the support piece because they are sandwiched. They are held between the support piece 14 and the printed front face 7, these two pieces being heat-sealed together in particular via the ribs. The front wall 7 and the rear wall 4 can be made of molded plastics material(s) suitable for being heat-sealed together. This heat-sealing is represented in the figures by shading the support piece 4. It follows that the printed front face of the front wall 7 remains free from any cavities or portions in relief. It is also possible to provide for the rear wall to be made of polystyrene.

In other embodiments (not shown), the disks and the rings may be held by studs, avoiding any heat-sealing between the printed front face and the ribs, the rings being in any event sandwiched between the support piece 4 and the printed front face 7 which may be heat-sealed, riveted, or snap-fastened together. Or else the rings could be held on the plastics support piece 4 by means of a flap, optionally constituted by a separate piece fitted thereto.

The windows 10 are provided through the printed front face so as to make up the price of an article. In this first embodiment, priority has been given to making the price of an article as large as possible, and also as compact as possible and as close as possible to the bottom of the label. Whence the superposition of the rings. Whence also the positions of the outside and inside ribs 14 and 16 for each ring. In addition, since the ribs are substantially in facing pairs, they form passages through which each ring must travel. This is with the exception of the disk 6*a*.

The digits printed on the peripheries of the display elements are caused to scroll past the windows 10 by turning the elements. Nevertheless, instead of holding each display element between two fingers in order to turn it about its axis as in a conventional label, friction pressure is applied against the display elements as when turning knurled wheels.

Only the openings 18 formed in the support piece 4 in the vicinity of the ribs gives access to the display elements sandwiched between the support piece 4 and the printed front face 7. This access does not make any gripping possible, so the only way to turn the elements is thus to drive them by friction in order to impart the desired movement thereto. It is therefore preferable for these openings 18 to be located in the vicinity of the ribs 14 and 16 so that the forces on the rings pass via the ribs and so as to avoid deforming and jamming the rings. It should be observed that by means of the openings 18 this solution advantageously directs the user towards the handling zones of the label even while turning the elements "blind", with the user looking at the front face 7, which is not the case for present labels. With present labels, it can be necessary for the user to turn the label over in order to find the proper zones for gripping.

Figure 5:
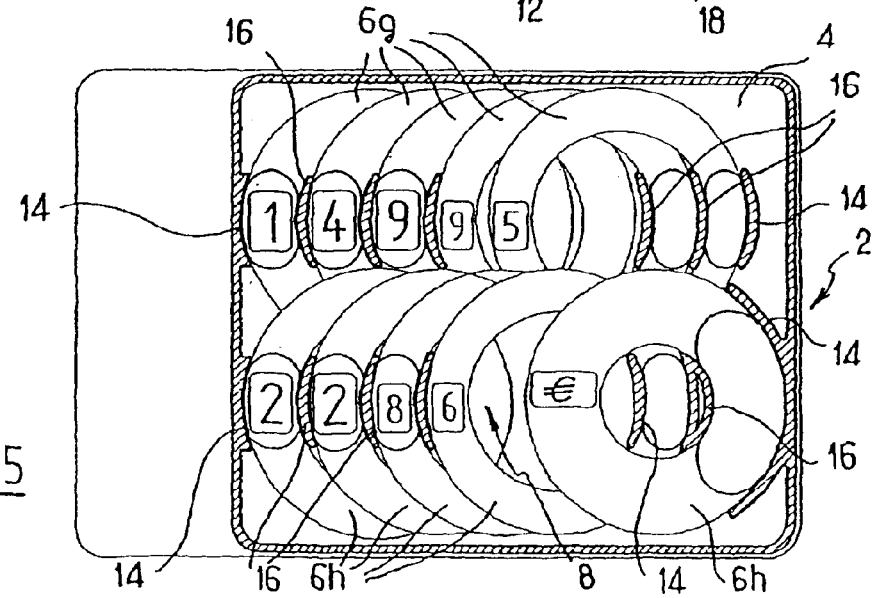

In the second preferred embodiment shown in FIG. 5, the label is suitable for displaying two prices, for example one in francs and another in euros. It is rectangular in shape. The edges of the rear wall 4 do not perform any function in guiding the display elements except for the two rings furthest to the left.

The display elements are all rings 6*g*, 6*h*. They are grouped together in two series. The geometrical centers of the rings in each series are in horizontal alignment. The lines extend one above the other. Each ring 6*g*, 6*h* partially overlaps other rings in the same series and also rings in the other series. Each ring is guided by a pair of ribs 14 and 16, most of which serve simultaneously to guide the outside edge of one ring and the inside edge of another ring in the same series. In each series, the ribs are intersected by the straight line corresponding to the direction in which the centers of the rings are in alignment.

In this case also, openings giving access to the rings are provided through the rear wall 12 between the corresponding ribs 14 and 16. The rings overlap so close to one another that in each series, the second, third, and fourth rings starting from the left overlap part of the central opening 8 of the first ring furthest to the left. This single opening has three ribs 16 therein guiding the second, third, and fourth rings respectively.

In the second embodiment, priority has been given to providing a label for displaying two prices that is as compact as possible, with the price of an article being shown as large as possible and as compactly as possible. This example presents the advantage for each series of rings 6*g*, 6*h* of aligning the ribs 14 and 16, the openings 8, and the handling zones 18 (not shown but likewise in horizontal alignment in each series) so as to make utilization as easy as possible. In addition, this example presents the advantage of minimizing the variety of rings, thus simplifying production and obtaining savings by the scale effect. Thus, it can be seen that the first to third rings of the top series and the first and second rings of the bottom series are all identical. The same is true for the fourth and fifth top rings and for the third and fourth bottom rings.

In the embodiments shown, and regardless of whether it is used for displaying one price or two prices, the invention makes it possible to place all of the rings on the support piece and to secure them in a single operation by heat-sealing the printed front face 7 to the rear plate 4. This solution thus makes it possible to envisage assembly that is automatic or semiautomatic. With the support piece being made of injected plastics material, it even makes it possible to envisage reducing the cost of labels for medium and long runs, or at least providing labels offering better performance for a cost that is substantially equivalent.

Concerning the risks of dirtying and thus of hygiene, this solution also provides an advantage by isolating the display elements better from the outside environment. In the limit, in the embodiment shown in FIG. 10, the openings 18 in the support piece 4 can be closed by one or more flexible membranes. By way of example, these can be obtained by dual injection or merely by using a film covering, thus ensuring that the labels are completely sealed, but without that impeding their use by rubbing against the rings since that is made possible by the flexibility and the deformability of the membranes. In a variant, and in the embodiment shown in FIG. 10, it is not membranes that are provided, but a sliding rigid closure strip 30 received in a rear housing and guided by dovetail-shaped profiles 32 in the support plate.

For increased sealing, it is possible to provide a flexible gasket (by dual injection or by overmolding) around the perimeter of the closure strip 30 or the opening that receives it.

The invention thus provides a label constituting a better compromise in economic, appearance, and functional terms, regardless of whether it displays one or two prices. Where appropriate, it makes it possible to increase the amount of overlap between display elements, enabling labels and thus the prices of articles to be more compact, making it possible to reduce or eliminate the visual impact of how the display elements are assembled when viewed from the printed front face 7, thereby increasing the perceived quality and readability of the labels, and to do so while conserving the ability to make these labels economically.

The solution of the invention consists in replacing axial guidance of the display elements by guidance that is offset away from the axis, making it possible to achieve a greater amount of overlap between elements. For this purpose, at least one of the disks guided by a pin, rivet, or the like, is replaced by a circular ring 6*b*–6*f*, 6*g*–6*h*, guided by ribs substantially matching its shape. These ribs are placed on the outside and/or the inside of each circular ring, and they are provided on a support piece secured to the printed front face. Since the inner and outer ribs are restricted to a fraction of the circumference and since they are substantially in register with each other, they form a passage through which each ring must pass.

Since the rings are sandwiched so as to be held in their housings, i.e. between their ribs and against the support piece, they can be turned by rubbing against the ring in its housing, somewhat like rubbing against a knurled wheel. For this purpose, the support piece has appropriately-positioned openings 18.

Assembly can be performed by placing all of the rings on the support piece 4 in their respective housings, and then in a single operation sandwiching them behind the front face 7 so as to hold them between their ribs.

This solution makes it possible to obtain labels that are compact, displaying article prices that are compact, whether one or two prices are displayed, while nevertheless conserving manufacturing costs that are low. For these new labels, the addition of the support piece 4 can be compensated by a reduction in assembly costs since all assembly is performed simultaneously. In addition, concerning the visual impact of the printed front face 7, it is possible for only the fixing of the support piece 4 to be visible depending on its definition, with the perceived quality and readability of these new labels being improved.

This solution also makes it possible to obtain the same labels in a hermetically sealed variant, by closing the openings 18 in the support piece 4 by means of flexible membranes or by a closure strip, as described above.

Figure 6:
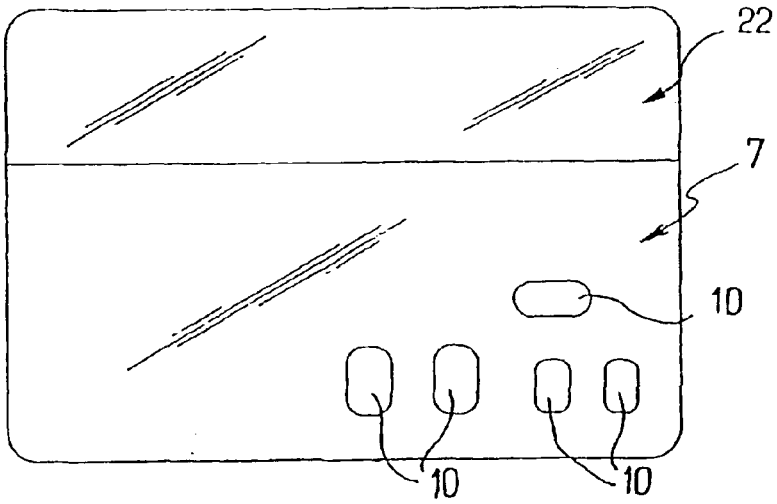
Figure 7:
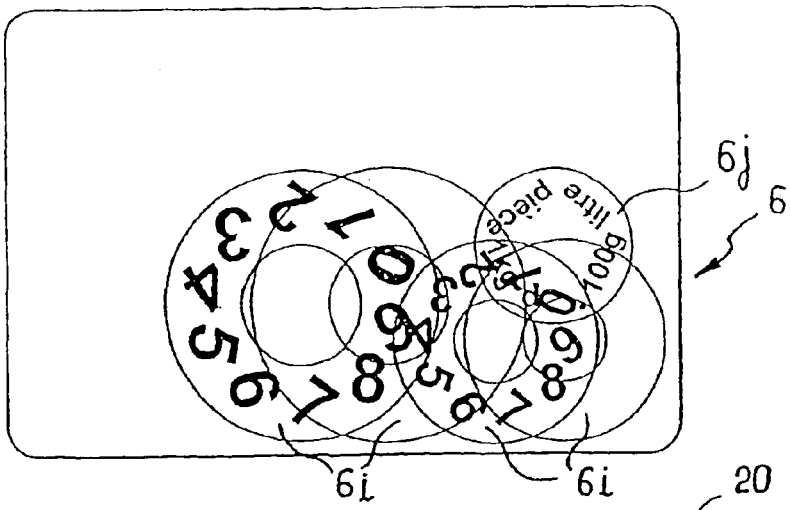
Figure 8:
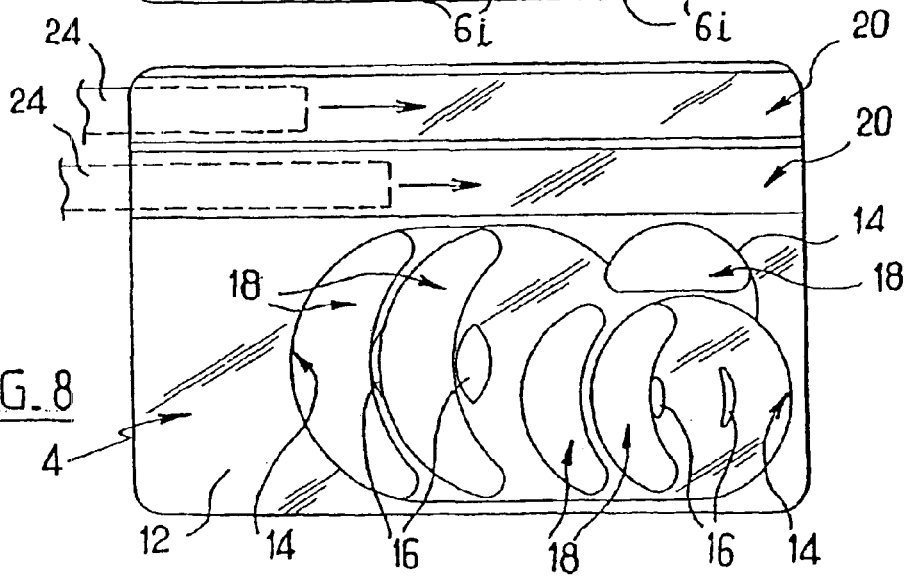

FIGS. 6 to 8 show a third embodiment of the invention. In this case the display elements are constituted by four rings 6*i* and by a disk 6*j*. The four rings 6*i* serve to display the price while the disk is used in this case to display expressions such as "100 g", "kg", "each", "liter", etc. . . . .

Instead of being isolated as in the first two embodiments, some of the ribs 14 are integrated in the thickness of the plate. Guidance is thus achieved by means of the edge of the thickness. During assembly, the four rings are put into place one after another on the support plate starting with the ring that is furthest to the right in FIG. 7, and then the disk is added.

It may be observed that for the two rings that are furthest to the right in FIG. 8, the guide ribs are diametrically opposite the opening 18.

One or more slideways 20 may be provided in the support plate 4 to receive removable banners 24 carrying text and/or illustrations. In this case there are two slideways sandwiched between the front face 7 and the rear support plate 4. The corresponding portion 22 of the front face should then be transparent so as to allow the banners to be seen.

Figure 9:
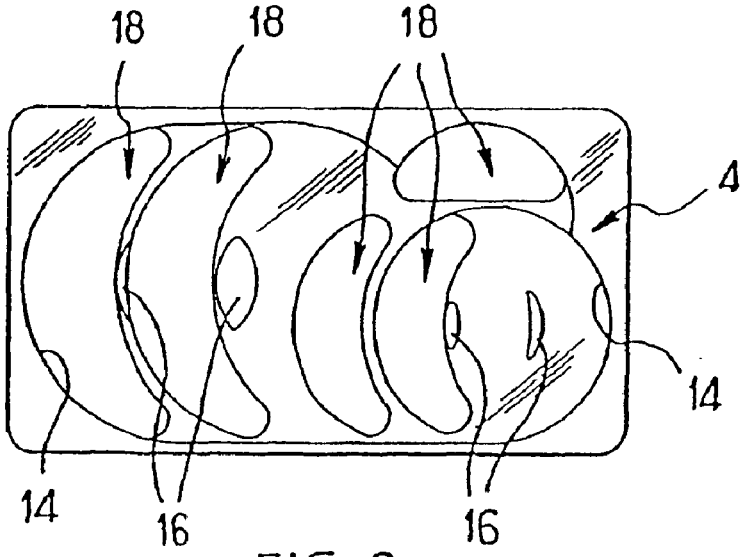
FIG. 9 is a figure analogous to FIGS. 7 and 8 showing a variant.

FIG. 9 shows the support plate 4 in a variant of the embodiment of FIG. 8. In this variant, the plate is reduced to the bare minimum size for receiving the elements 6*i*, 6*j*.

The front face is reduced correspondingly. It is thus possible to make a "small" label as compared with the "large" label of FIG. 8.

Figure 10:
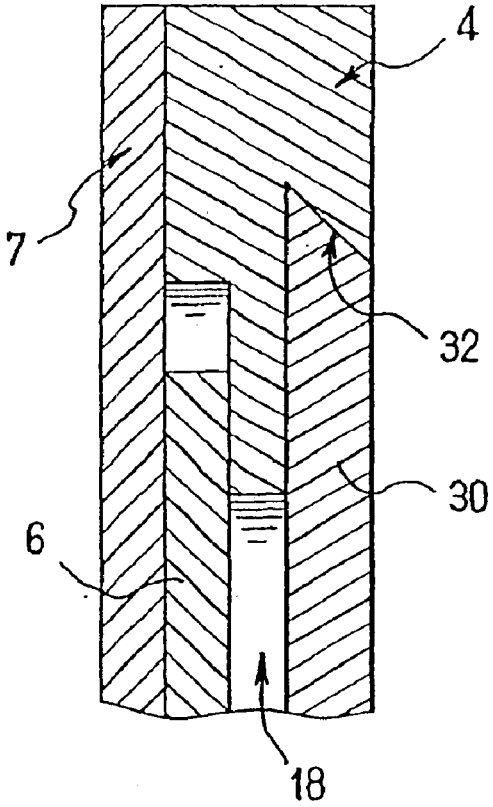
FIG. 10 is a fragmentary cross-section view through another variant label.

The plate may be fixed to a spike, a stand, etc. forming a label support, either directly or via the back piece 30 for the embodiment of FIG. 10.

What is claimed is:

1. A label comprising a support (4, 7); display elements (6*a*–*f*; 6*g*–*h*; 6*i*; 6*j*); and mounting means (14, 16) for mounting the display elements so they are free to rotate on the support, wherein for at least one of the display elements (6*a*–*e*; 6*g*–*h*; 6*i*; 6*j*), the mounting means (14, 16) extend at a distance from a center of the element and are discontinuous in a circumferential direction around the center, and the mounting means (16) bear against an inside edge of at least one of the display elements (6*b*–*f*; 6*g*–*h*, 6*i*, 6*i*).

2. A label according to claim 1, wherein for at least one of said display elements, the mounting means (4) bear against an outside edge of the element (6*a*–*f*; 6*g*–*h*, 6*i*, 6*j*).

3. A label according to claim 1, wherein for at least one of said display elements, the mounting means (14, 16) comprise a rib.

4. A label according to claim 1, wherein for at least one of said display elements, the mounting means (14, 16) extend over less than a half a turn in the circumferential direction.

5. A label according to claim 1, wherein the mounting means (14, 16) are contiguous with one another for at least two of the display elements (6*a*, 6*b*; 6*h*; 6*i*).

6. A label according to claim 1, wherein the label has a front wall (7) presenting windows (10) through which the display elements (6*a*–*f*; 6*g*–*h*, 6*i*, 6*j*) are visible.

7. A label according to claim 1, wherein the label has a rear wall (4) presenting windows (18) through which the display elements (6*a–f*; 6*g–h*, 6*i*, 6*j*) are accessible in order to be maneuvered.

8. A label according to claim 7, characterized in that the windows (189) in the rear wall are closed by a leakproof flexible membrane (30).

9. A label according to claim 8, characterized in that the windows (18) in the rear wall are closed by a removable closure strip (30).

10. A label according to claim 7 or claim 8, wherein, for at least one of said display elements, the mounting means (14, 16), the opening in the rear wall (18), and the center of the element (6*a–f*; 6*g–h*, 6*i*, 6*j*) are in alignment.

11. A label according to claim 1, wherein at least one of the display elements (6*b–f*; 6*g–h*, 6*i*, 6*j*) is in the form of a ring.

12. A label according to claim 1, wherein at least one of the display elements (6*a*, 6*j*) is in the form of a disk.

13. A label according to claim 1, wherein for at least one of said display elements, the mounting means (14, 16) extend over less than one-third of a turn.

14. A label comprising a support (4, 7); display elements (6*a–f*; 6*g–h*; 6*i*; 6*j*); and mounting means (14, 16) for mounting the display elements so they are free to rotate on the support, wherein for at least one of the display elements (6*a–e*; 6*g–h*; 6*i*; 6*j*), the mounting means (14, 16) extend at a distance from a center of the element and are discontinuous in a circumferential direction around the center, and the mounting means (14, 16) are contiguous with one another for at least two of the display elements (6*a*, 6*b*; 6*h*; 6*i*).

* * * * *

UNITED STATES PATENT AND TRADEMARK OFFICE

CERTIFICATE OF CORRECTION

PATENT NO. : 6,871,432 B2
DATED : March 29, 2005
INVENTOR(S) : Lacroix

It is certified that error appears in the above-identified patent and that said Letters Patent is hereby corrected as shown below:

Column 6,
Line 51, please delete "6i, 6i" and insert -- 6i, 6j --.

Signed and Sealed this

Twenty-fifth Day of October, 2005

JON W. DUDAS
*Director of the United States Patent and Trademark Office*